US009302822B2

(12) United States Patent
Hoskins

(10) Patent No.: US 9,302,822 B2
(45) Date of Patent: Apr. 5, 2016

(54) CLOSURES FOR BLADDERS

(71) Applicant: Matt Hoskins, Bend, OR (US)

(72) Inventor: Matt Hoskins, Bend, OR (US)

( * ) Notice: Subject to any disclaimer, the term of this patent is extended or adjusted under 35 U.S.C. 154(b) by 0 days.

(21) Appl. No.: 14/473,899

(22) Filed: Aug. 29, 2014

(65) Prior Publication Data

US 2015/0093052 A1 Apr. 2, 2015

Related U.S. Application Data

(60) Provisional application No. 61/885,099, filed on Oct. 1, 2013.

(51) Int. Cl.
*B65D 33/16* (2006.01)
*B65D 33/24* (2006.01)
*A45F 3/20* (2006.01)

(52) U.S. Cl.
CPC .. *B65D 33/24* (2013.01); *A45F 3/20* (2013.01)

(58) Field of Classification Search
CPC ..... B65D 33/1666; B65D 33/1675; A44C 11/22; A44C 13/06; A44C 13/008
USPC ..... 383/68, 33–34.1; 24/30.5 R; 150/123
See application file for complete search history.

(56) References Cited

U.S. PATENT DOCUMENTS 393,360 A * 11/1888 Cook ..... A01M 31/00 383/34.1
1,625,605 A * 4/1927 Hiering ..... A45C 13/06 292/13
2,055,695 A 3/1936 Macdonald et al.
2,304,528 A 12/1942 Bafia et al.
2,599,738 A 6/1952 Ames
2,606,587 A 8/1952 Porter et al.
2,678,671 A * 5/1954 Rifkin ..... A45C 13/06 383/68
3,727,829 A 4/1973 Hüni
5,116,139 A 5/1992 Young et al.
5,797,683 A 8/1998 Gunzi et al.
D452,377 S 12/2001 Cooke et al.
D489,180 S * 5/2004 Kramer ..... D3/303
6,821,018 B1 11/2004 Denko
7,648,276 B2 1/2010 Gill
7,757,384 B2 7/2010 MacAuley et al.
8,186,881 B2 5/2012 Lyon et al.

* cited by examiner

*Primary Examiner* — Jes F Pascua

(74) *Attorney, Agent, or Firm* — Klarquist Sparkman, LLP

(57) ABSTRACT

Some disclosed bladder closures comprise a first rigid member adapted to be secured to a first side of a bladder opening and a second rigid member adapted to be secured to a second side of the bladder opening opposite from the first side. At least one fastener is included for clamping the first and second rigid members together to seal the bladder opening. The fastener is rotatably mounted in the first rigid member and comprises a latch positioned on an outer side of the first rigid member, a shaft that passes through the first rigid member, and at least one tab that engages with a portion of the second rigid member when the latch is rotated. The latch pivots at least partially around the shaft to engage with a projection of the second rigid member that extends through a hole in the first rigid member to lock the fastener in place.

19 Claims, 23 Drawing Sheets

CLOSURES FOR BLADDERS

CROSS REFERENCE TO RELATED APPLICATION

This application claims the benefit of U.S. Provisional Patent Application No. 61/885,099, entitled CLOSURES FOR BLADDERS, filed on Oct. 1, 2013, which is incorporated by reference herein.

FIELD

The application is related to fluid bladders and closures therefor, such as for personal hydration systems or other fluid handling purposes.

BACKGROUND

Sufficient hydration is important for replacing bodily fluids during extended periods of aerobic activity, such as cycling. Currently, several methods are known for getting fluids to a person engaged in aerobic activity and in need of fluid replenishment. In an attempt to overcome the deficiencies of water bottles, personal hydration systems have been developed that include a reservoir for holding fluid, a flexible drink tube for conveying the fluid from the reservoir to the person engaged in aerobic activity, and a mouth-operated valve attached to the end of the tube. Reservoirs for hydration systems are generally made from sheets of flexible materials that have been sealed at their edges to provide a watertight container. Soft-side reservoirs or bladders are relatively inexpensive, can be comfortably worn within in a back pack or waist pack, and withstand impact well.

Hydration system bladders typically include a closeable fill port and a drain port that connects to the drink tube. Configurations for the hydration bladder fill ports include screw cap ports welded to one side of the bladder or into the bladder seam. Another approach is to fill through an open seam at the top of the bladder and employ a zipper type or roll-top closure that seals in the fluid.

The various types of fill ports are designed meet certain needs of bladder-based hydration systems. Screw top ports offer secure, robust closing method that is familiar to users. Welding ports to the bladder material is a low-cost manufacturing method that integrates into the processes employed in forming and sealing the bladder edges. Roll and zip top closures offer a wide opening for filling and adding ice to the bladder and facilitate cleaning and drying.

Despite the capabilities of current bladder fill port designs, there remain problems associated with their use. For example, screw-ports welded to the bladder's side can be oversized to offer easier filling, but their side-facing orientation can make them difficult to fill under a faucet. Side-mounted ports can require that the bladder be removed from its hydration pack for filling. Cleaning and drying bladders made with side-mounted fill ports can be troublesome due to the size of the port opening and the tendency of the bladder sides to collapse together. Seam-welded ports can be placed at the top of the bladder, but can be more difficult to weld reliably and can become bulky when made with oversized openings. Roll and zip top closures may not seal as reliably as screw-top closures and may require extra effort to keep them opened during filling.

SUMMARY

Disclosed herein are embodiments of bladders assemblies having closures for sealing an upper opening of the bladder.

The disclosed bladder assemblies can provide reliable sealing, top-mounted orientation, easy filling, and/or can facilitate easy clean-up and drying of the bladder.

In some embodiments, a bladder closure comprises a first rigid member adapted to be secured to a first side of an upper bladder opening and a second rigid member adapted to be secured to a second side of the upper bladder opening opposite from the first side. At least one fastener is included for clamping the first and second rigid members together to seal the bladder opening. The fastener is rotatably mounted in a fastener mounting opening of the first rigid member and comprises a latch positioned on an outer side of the first rigid member and a shaft that passes through the fastener mounting opening and extends from an inner side of the first rigid member. The shaft includes at least one tab or flange that projects from an end of the shaft on the inner side of the first rigid member to engage with a portion of the second rigid member when the latch is rotated. The latch extends radially from an end of the shaft on the outer side of the first rigid member and includes locking portion that pivots at least partially around the shaft to engage with a projection of the second rigid member that extends through a hole in the first rigid member to the outer side of the first rigid member.

When the bladder closure is in a closed position, the latch is rotated such that the tab that projects from the fastener shaft is engaged with the second rigid member to provide a clamping force that clamps the first and second rigid members together to seal a bladder opening, and the locking portion of the latch is engaged with the projection on the outer side of the first rigid member to lock the fastener in the closed position.

In other embodiments, the first and second rigid members can be hinged to each other and only one of the rigid members is adapted to be fixed to one side of an upper bladder opening. In an open position, the opposite side of the bladder opening is free to open away from the first side and the bladder closure fixed to the first side. In the closed position, the two sides of the bladder opening are brought together and the second rigid member is pivoted relative to the first rigid member to be positioned on the outer side of the second side of the upper bladder opening. In this position, the fastener shaft can be rotated to engage the tab of the fastener shaft with the second rigid portion to clamp the bladder opening closed and the latch can lockingly engage with the projection of the second rigid member to keep the fastener from rotating.

In some embodiments, the tab on the fastener shaft can engage with a ramped surface on the second rigid member such that the clamping force is gradually increased as the shaft is rotated and the tab moves up the ramp. Two or more tabs can be included around the shaft that each engage with their own inclined ramps on the second rigid member.

In some embodiments, the bladder closure includes two or more of said fasteners and/or two or more of said projections to provide a more even clamping force distribution across the bladder opening.

The foregoing and other objects, features, and advantages of the disclosed technology will become more apparent from the following detailed description, which proceeds with reference to the accompanying figures.

DETAILED DESCRIPTION

Figure 1:
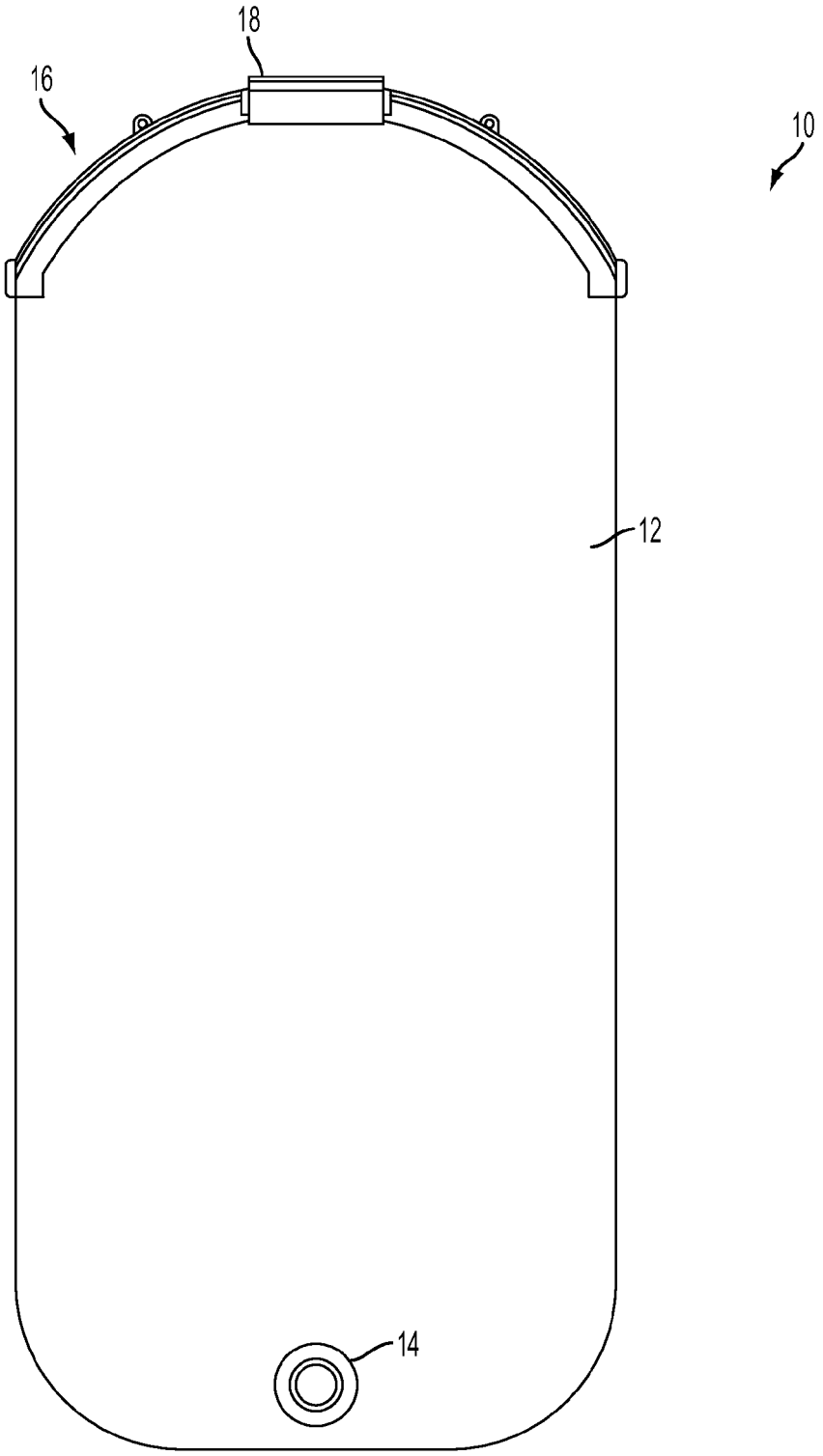
FIG. 1 is a front elevation view of an exemplary fluid bladder having an upper closure.

Disclosed herein are embodiments of fluid bladders and closures therefor that offer reliable sealing, top-mounted orientation, easy filling, and/or that facilitate clean-up and drying of the bladder. Various fill port embodiments for use in a fluid bladder are disclosed. Some disclosed bladders include a re-sealable closure located at the top of a bladder that can provide a generous passageway for cleaning and drying out of the bladder's interior. In certain embodiments, the closure is designed such that when it is in an open position, the closure holds the bladder walls away from one another to further facilitate drying.

In some embodiments, the bladder closure comprises a pair of rigid frames sealed to the bladder and arranged in a clamshell configuration. Pivoting of the frames relative to each other opens or closes that bladder top. The closure can be configured so that the closure's frames can be set in an open position opening up the bladder's interior and allowing for extended drying. A locking mechanism built into the closure assembly can be actuated to lock the assembly into a closed state, sealing off the bladder.

Other embodiments can have a dual fill port configuration that offers filling through a smaller side fill port and/or via the bladder's sealable open end. Some dual port embodiments include a rigid plate with a central fill port and locking member. A rigid, elongated, slightly curved plate featuring a fill port can be attached to one side of the bladder at the bladder's top end. The plate may be located so that the top edge of the bladder can be folded over or under the top edge of the plate effectively sealing the bladder's top end. A locking member can be employed to secure or release the bladder top fold. In such embodiments, the bladder interior can be accessed by opening the fill port or by releasing the locking member and opening the bladder's top edge. The fill port can comprise a screw top port and cap, a self-sealing elastomeric port, and/or a fill port with an integrated, closeable plug.

In some embodiments, a self-sealing fill port can be included within the bladder, such as by adding a filling conduit inside the bladder. Such a filling conduit can comprise a flattened tube that is attached to the top seam of the bladder at one of its open ends, while the other open end is attached within the bladder such that inadvertent eversion of the conduit from within the bladder is restricted. The flattened tube shape of the conduit can naturally impede fluid flow due to its tendency to collapse on itself and the surface tension that exists between the sides of the tube when it is collapsed. Furthermore, the end of the filling conduit that is inside the bladder is subject to the fluid pressure within the filled bladder. The internal bladder pressure pushes the sides of the conduit together to restrict fluid flow. To fill the bladder, the conduit's top end can be manually spread open to receive fluid from a fluid source. The flattened conduit can be attached to the bladder in such a way that if desired, the conduit may be unfolded from the bladder to allow for bladder cleaning and drying out. A drain port can be attached to the bladder in the conventional fashion.

Figure 2:
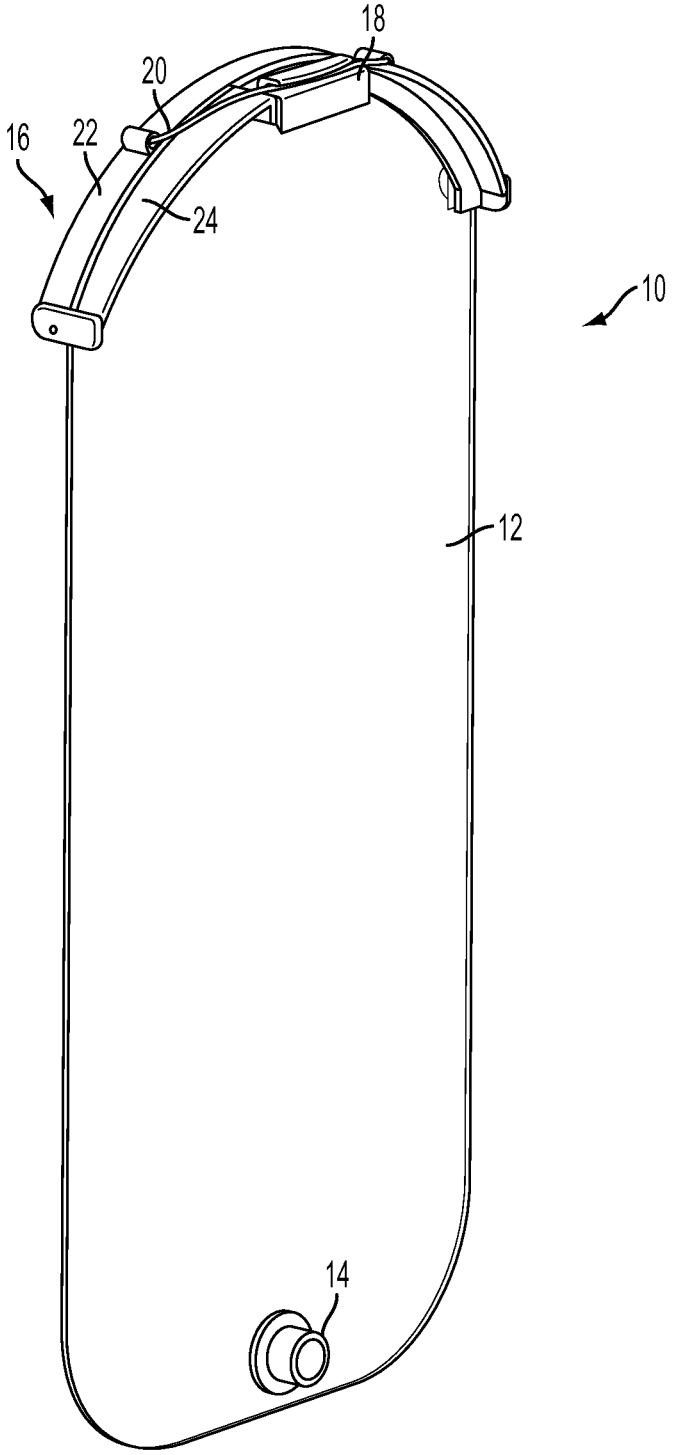
FIG. 2 is perspective view of the fluid bladder of FIG. 1.

FIG. 1 shows a bladder assembly 10 comprising bladder 12, exit port 14, clamshell closure 16, and draw latch 18. FIG. 2 is a perspective view of bladder assembly 10 comprising bladder 12, exit port 14, clamshell closure 16 having jaws 22 and 24, draw latch 18, and an engaging loop 20.

Figure 3A:
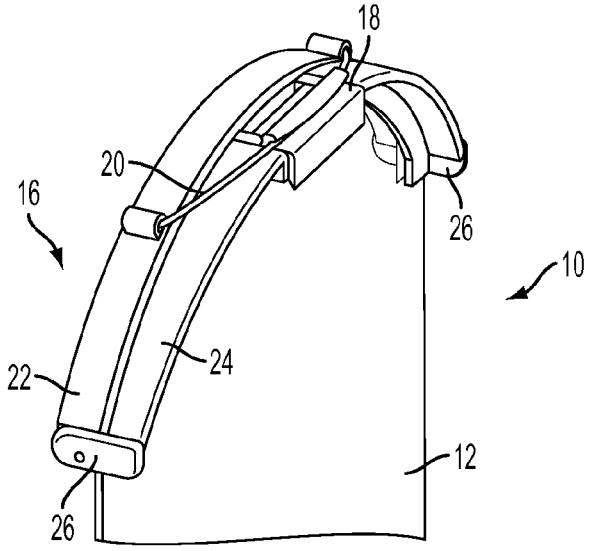
FIG. 3A shows the upper closure of the fluid bladder of FIG. 1 in a closed position.

FIG. 3A is a detailed view of clamshell closure 16 in a closed and locked position. Draw latch 18 captures engaging loop 20 to hold the jaws 22, 24 of clamshell closure 16 together with sufficient force to prevent fluid from leaking from bladder 12. Draw latch 18 and engaging loop 20 are just one example of a locking mechanism for sealing clamshell closure 16. A number of other clamping type mechanisms can be employed including, but not limited to, screw-type clamps, spring clamps, locking straps, quick-release cams, and keeper arrangements which slide over the top of the clamshell.

Figure 3B:
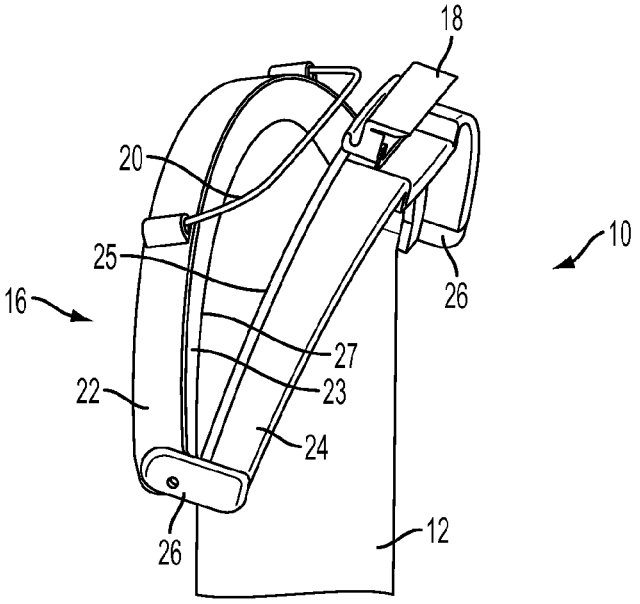
FIG. 3B shows the upper closure of the fluid bladder of FIG. 1 in an open position.

FIG. 3B shows clamshell closure 16 in its open position. Draw latch 18 is in a raised position releasing engaging loop 20 and acts as a handle for the user to grasp as bladder 12 is filled with fluid. First clamshell jaw 22 connects to second clamshell jaw 24 at hinge 26 on both sides. First clamshell jaw 22 features first sealing surface 23 which acts against second sealing surface 25 on the face of second clamshell jaw 24. Bladder 12 is sealed along its two top edges to first sealing surface 23 and second sealing surface 25 respectively. Gasket 27, runs along the length of sealing surface 23 to help seal bladder 12 when it is in the closed position. Hinge 26 can be constructed with sufficient friction to allow first and second clamshell jaws 22 and 24 to be fixed in an open position if desired.

Figure 4:
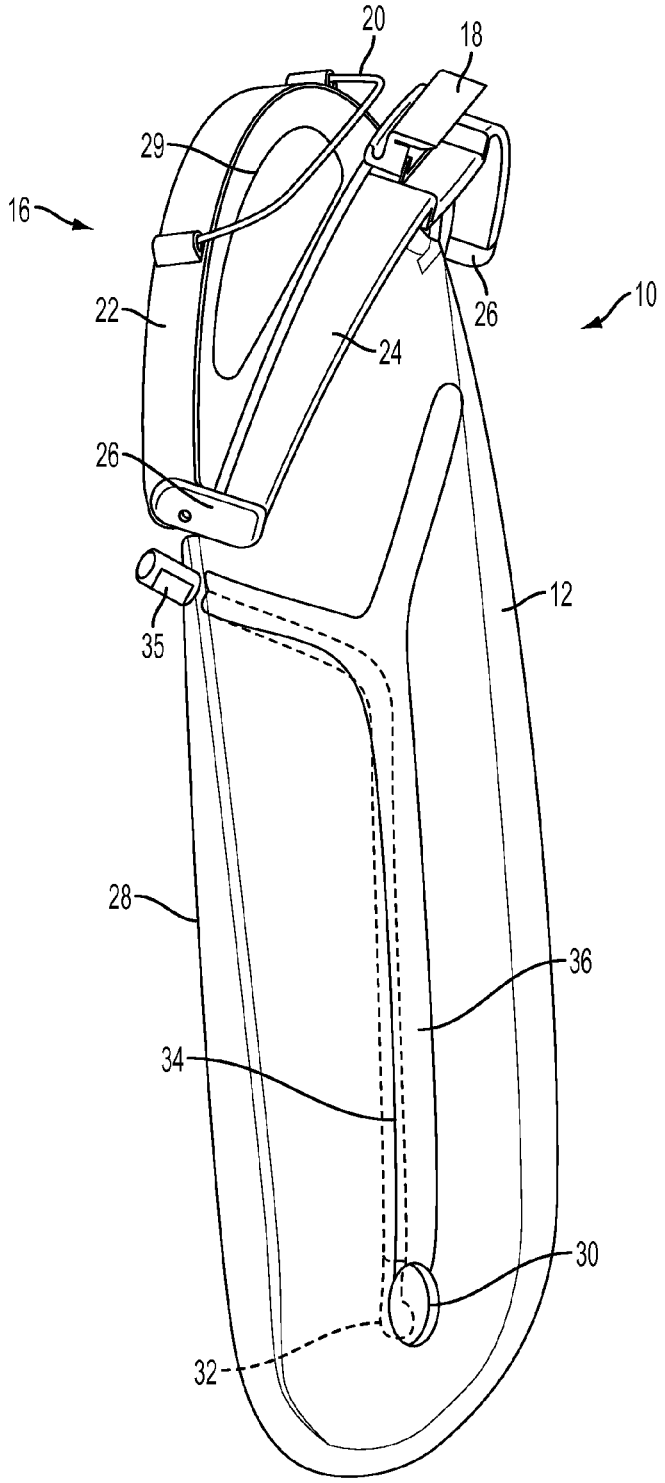
FIG. 4 shows another exemplary fluid bladder having a stabilizing plate.

FIG. 4 shows an alternative embodiment of clamshell closure 16 and bladder assembly 10. In this embodiment, first clamshell jaw 22 is connected to stabilizing plate 28. Stabilizing plate 28 is attached to the back of bladder 12. When attached in this fashion, stabilizing plate provides column strength to bladder assembly 10 during pack loading. Additionally, the bonding of bladder 12 to stabilizing plate 28 prevents bladder 12 from fully expanding into a cylindrical shape during filling, thus bladder 12 maintains a lower profile for pack loading and does not bulge unnecessarily into the user's back. Stabilizing plate 28 features top handle 29 which is accessed from the back of bladder assembly 10. Stabilizing plate 28 features hole 30 through which elbow exit port 32 passes out of the backside of bladder 12. Elbow exit port 32 is connected to drink tube 34 which sits within tube channel 36. Tube channel 36 is formed on the backside of stabilizing plate 28 and is shaped like a "Y" allowing drink tube 34 to be routed either left or right, or both. Drink tube 34 exits tube channel 36 and terminates in quick disconnect fitting 35, which provides easy bladder removal from the hydration pack as the drink tube can be disconnected at the top of the bladder.

Figure 5A:
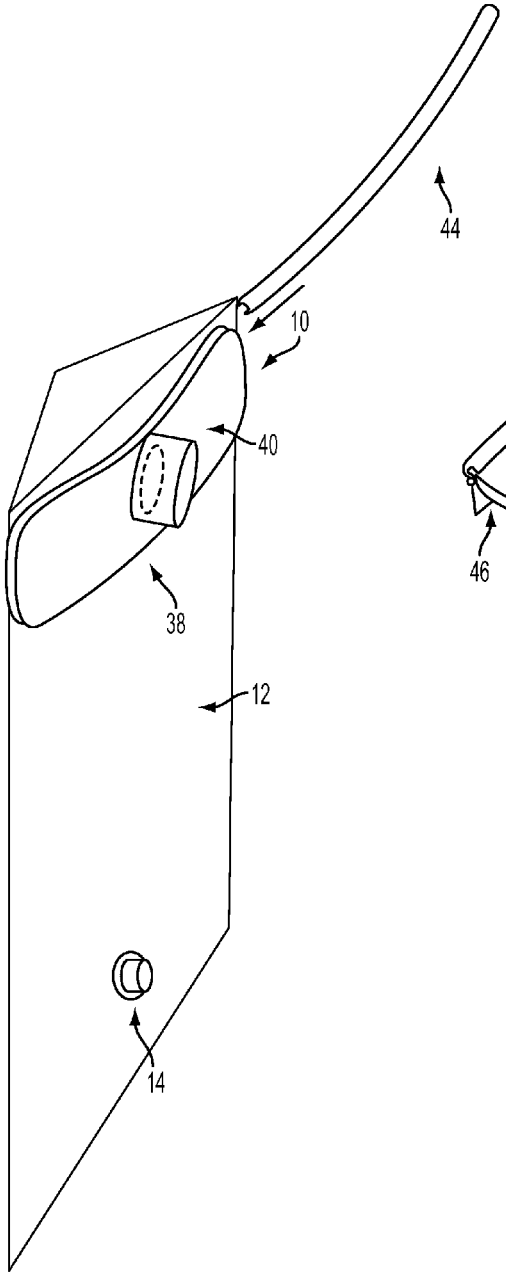
FIGS. 5A and 5B a dual port closure for a fluid bladder.

FIG. 5A shows another bladder closure embodiment. In this design, bladder assembly 10 comprises bladder 12, exit port 14 and dual port closure 38. Dual port closure 38 features top plate 40, fill port 42, and keeper member 44. FIG. 5A shows dual port closure 38 opened to allow filling, cleaning, or drying. Top plate 40 can be sealed on its underside to one side of bladder 12 towards the top of the bladder. Top plate 40 can be located on bladder 12 such that the top of bladder 12 may be folded over. Top plate 40 can be curved slightly to allow bladder 12 to expand outward for filling. Fill port 42 features a passageway that extends through top plate 40 and one side of bladder 12 in the area where it is bonded to top plate 40.

Figure 5B:
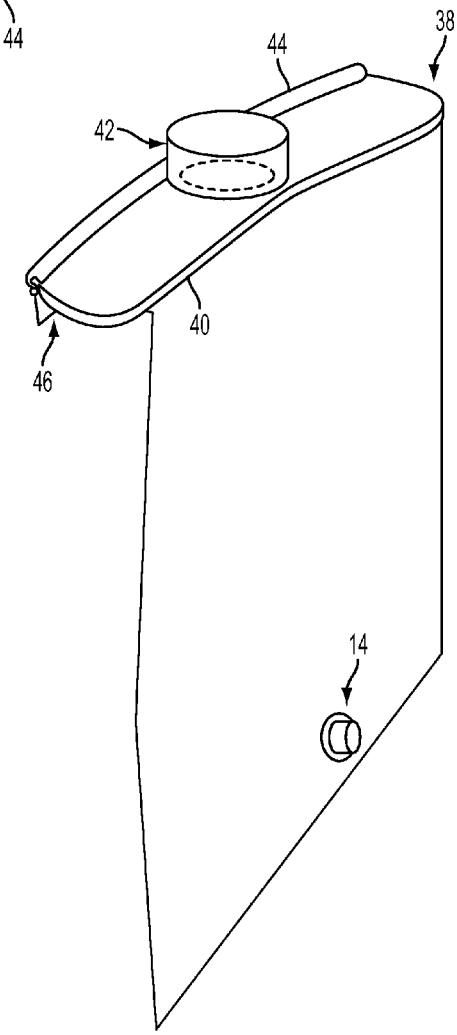

In FIG. 5B, dual port closure 38 is show in its sealed state. Bladder 12 is folded at fold 46 and keeper member 44 is slid over fold 46 and the edge of top plate 40 to lock and seal the top of bladder 12. Keeper member 44 may be configured as a hinged piece which can fold over and lock bladder fold 46 in place. A gasket may be added to top plate 40 along fold 46 to further enhance bladder sealing. Fill port 42 may be a screw top port or other design that allows quick filling and draining with or without removal of the bladder from the hydration pack. For cleaning, drying, or adding of ice, keeper member 44 can be released and the top end of bladder 12 fully opened.

Figure 6A:
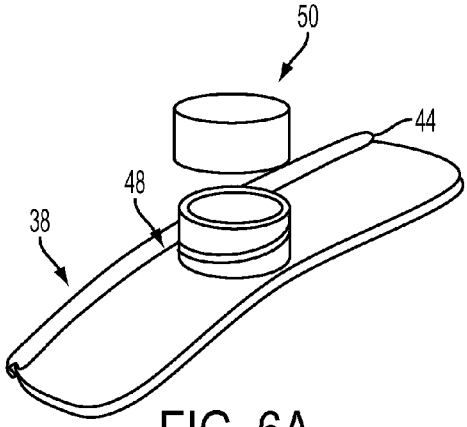
FIGS. 6A-6D show alternative fill port designs for a dual port closure.
Figure 6B:
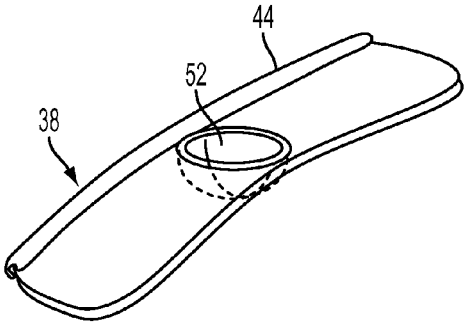
Figure 6C:
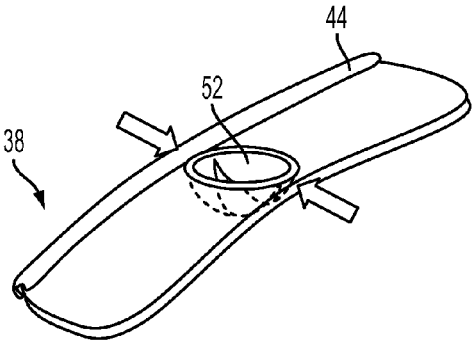
Figure 6D:
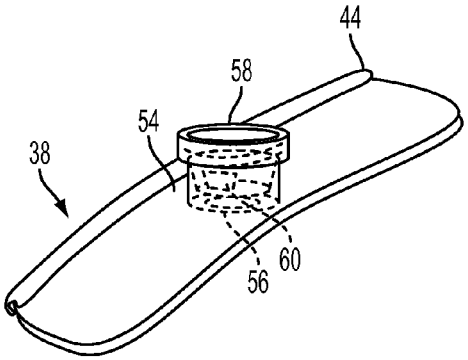

FIGS. 6A, 6B, 6C, and 6D show alternative fill port designs for dual port closure 38. FIG. 6A shows screw top spout 48 and cap 50. FIG. 6B shows elastomeric fill port 52 first in a closed position and in FIG. 6C squeezed to an open position. Elastomeric fill port 52 may be configured as a concave dome as shown or similar to a duckbill valve or other configuration where a slit that is normally pressed closed by internal pressure can be manually opened via external deformation. FIG. 6D features capless fill port 54 which includes hole 56 and plug 58. Plug 58 is threaded onto fill port 54 and tapers as it extends to hole 56. Plug 58 features side hole 60 in its tapered segment. When tightened down, plug 58 seals hole 56. When unscrewed slightly, fluid is directed into the hollow center of plug 58 where it then passes through side hole 60 and hole 56 into the bladder's interior, thus allowing bladder filling without the need for a separate port cap.

Figure 7A:
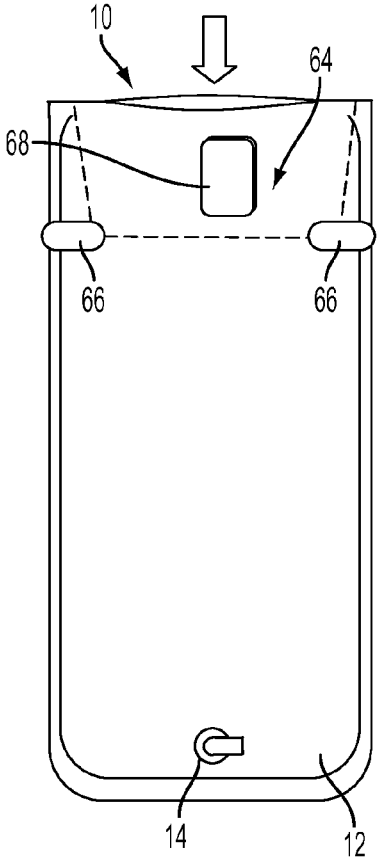
FIGS. 7A and 7B show another exemplary fluid bladder having a fold-over upper closure.
Figure 7B:
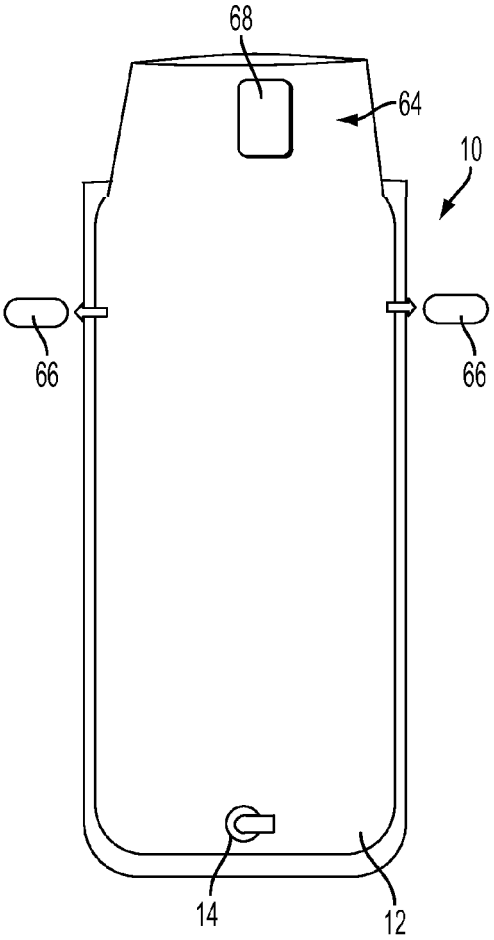

FIG. 7A shows another embodiment of bladder assembly 10 that includes flattened conduit 64 attached to the top end of bladder 12 and folded inwardly inside of the top of the bladder. FIG. 7B shows the conduit 64 unfolded from within bladder 18 and projecting upward for cleaning and drying. In the configuration of FIG. 7A, the conduit 64 forms a duck-bill check valve that allows fluid to readily enter the top of the bladder 12 but collapses to restrict fluid from flowing out of the bladder. The conduit 64 can be an integrated extension of the rest of the bladder 12 or can be a separate components that is attached to the top end of the bladder. Integrated or removable clamps or clips 66 or similar fasteners can help seal the free end of conduit 64 between the walls of the bladder 12 in the closed position of FIG. 7A. In some embodiments, a rigid spacer 68 is hingedly coupled within conduit 64 and is operable to be pivoted from a closed position lying flat between the internal walls of the conduit 64 to an open position generally perpendicular to the walls of the conduit to hold the conduit open for filling. The hinged spacer 68 can pivot about a generally vertical axis relative to one wall of the conduit, for example, to minimize obstruction to fluid flow through the conduit along the axial direction.

Figure 8A:
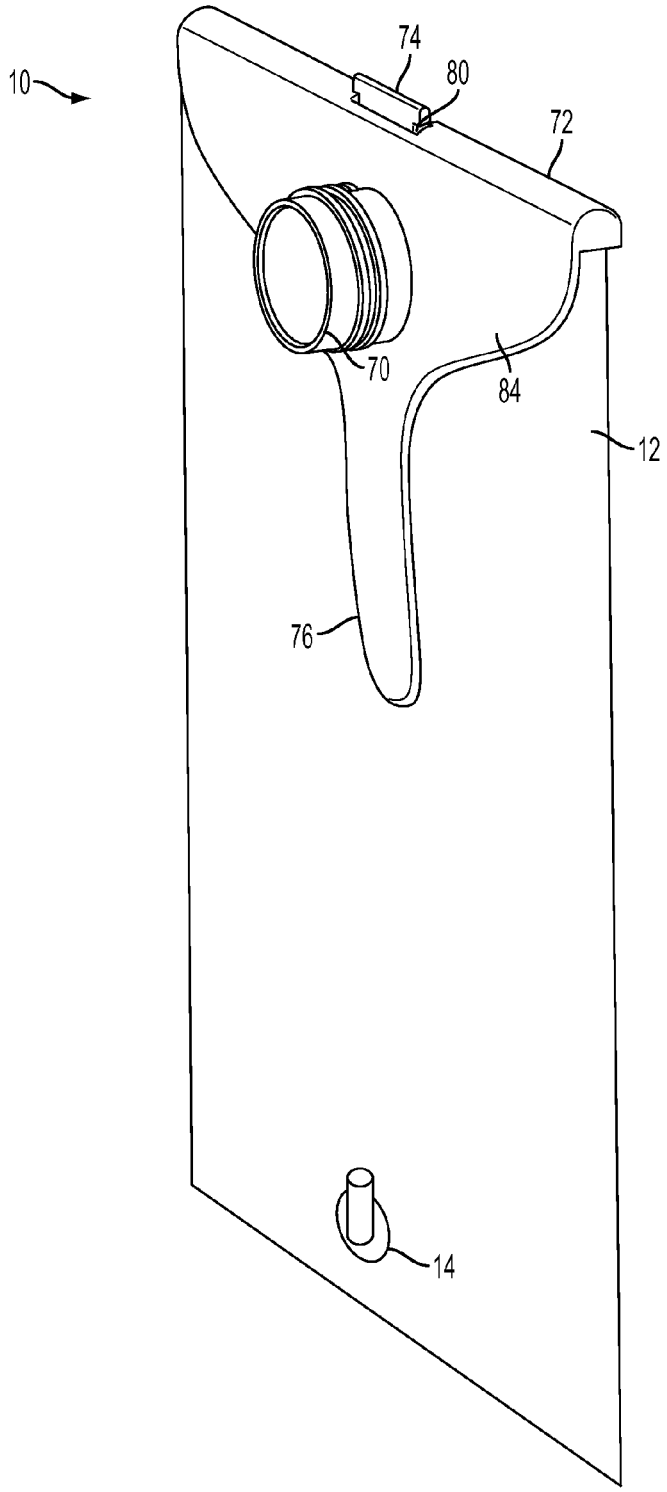
FIG. 8A is a front perspective view of another exemplary fluid bladder with an upper closure.

FIG. 8A shows yet another bladder embodiment. In this embodiment, bladder assembly 10 includes a dual port closure 72 which can include screwport 70, cam tab 74, handle 76, and/or a screw port cap (not shown). An exit port 14 allows connection to a fluid conduit for bladder emptying.

Figure 8B:
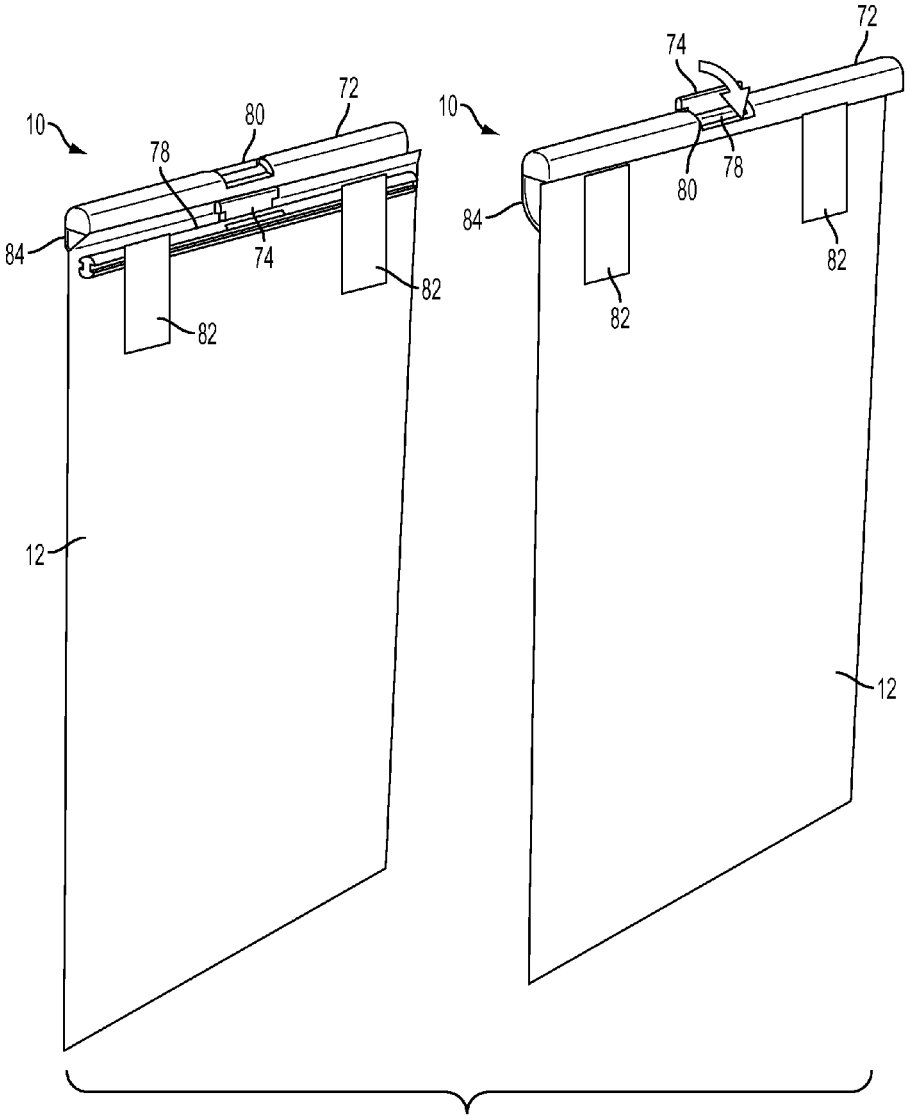
FIG. 8B shows rear perspective views of the fluid bladder of FIG. 8A, in both an unlocked position (left) and a partially locked position (right).

FIG. 8B depicts bladder assembly 10 of FIG. 8A with the unsealed bladder top in its open (left) and closed (right) positions. In the open position, cam 78, which connects to the back sheet of the bladder such as via loops or similar structures 82, is pulled down and out to separate the front bladder sheet from the back bladder sheet along the bladder's unsealed top edge. The front sheet of the bladder is sealed along its top edge to the dual port closure 72 body. In the closed and seal position, cam 78 is inserted back into dual port closure 72. Cam tab 74 is positioned within cut-out 80 and rotated such that cam 78 exerts pressure along the top edge of the bladder and seals its contents.

Figure 8C:
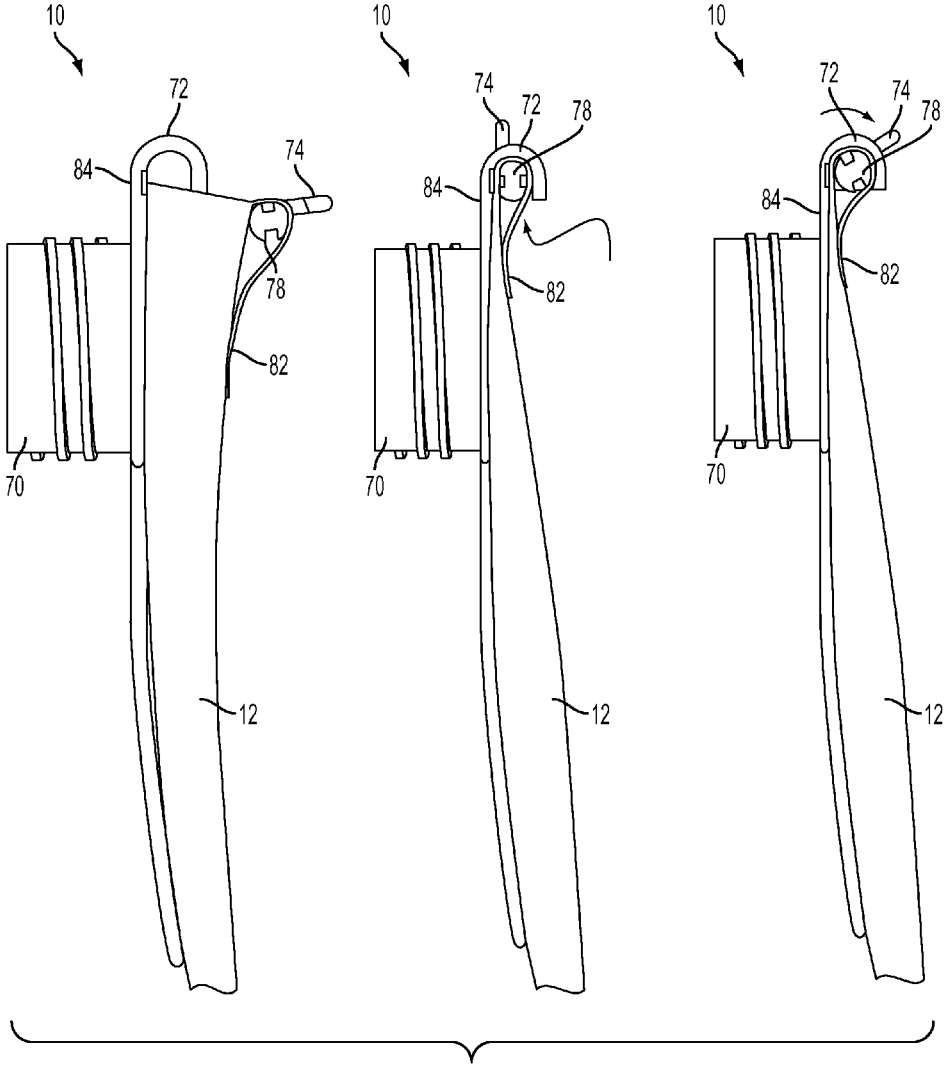
FIG. 8C shows side elevations views of the fluid bladder of FIG. 8A, in an open position (left), a closed but unlocked position (middle) and a closed and locked position (right).

FIG. 8C shows a closure of the bladder assembly 10 of FIGS. 8A and 8B in side elevation view. In the configuration shown at the left-hand side of FIG. 8C, cam 78 is pulled away to open bladder 12. Next, as shown in the center image of FIG. 8C, cam tab 74 is brought up into cut-out 80 and is then rotated, as shown in the right-hand image of FIG. 8C, so that ribs on the cam 78 apply pressure along the top edge of the bladder against the closure 72. An optional elastomeric strip can run along the length of the top edge of the bladder and provide a sealing seat for cam ribs. Cam tab 74 and cut-out 80 can include locking and/or indexing features so that cam tab 74 is secured in its closed position.

Figure 9:
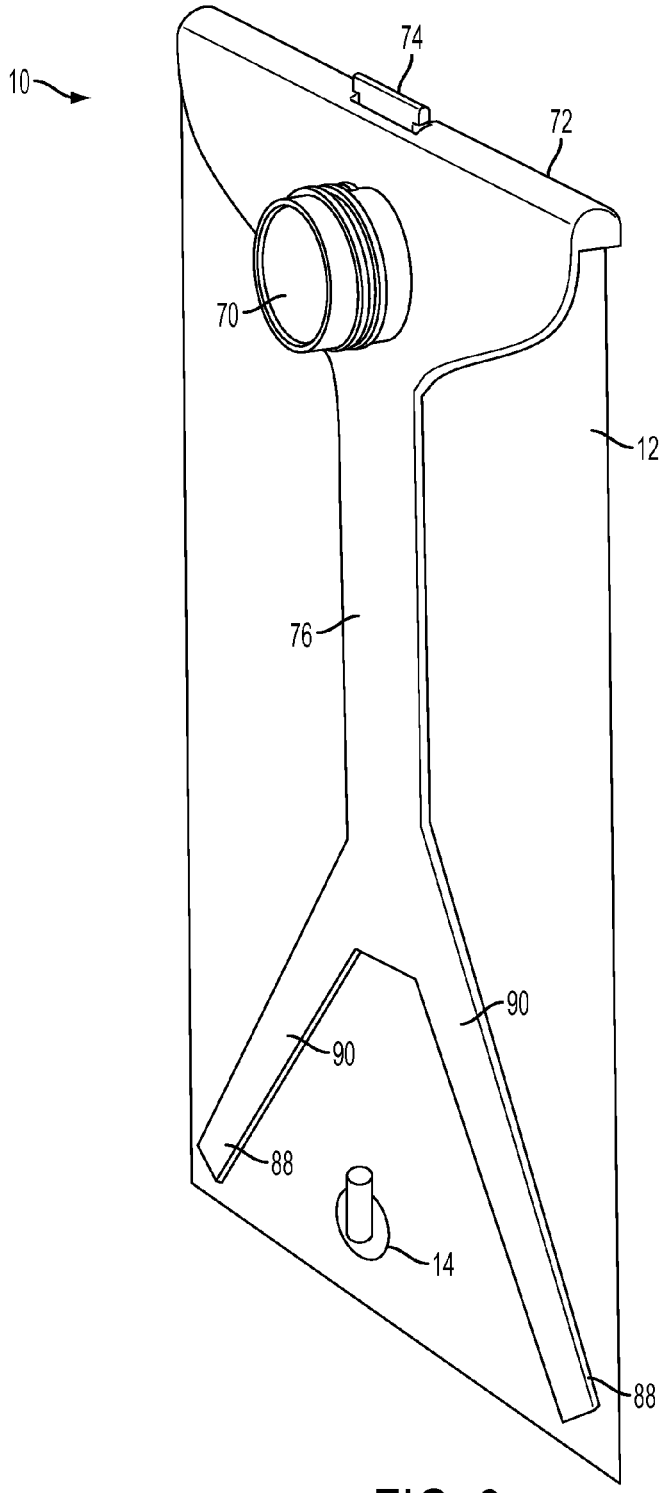
FIG. 9 shows an alternative embodiment of the fluid bladder shown in FIGS. 8A-8C, including a handle.
Figure 10:
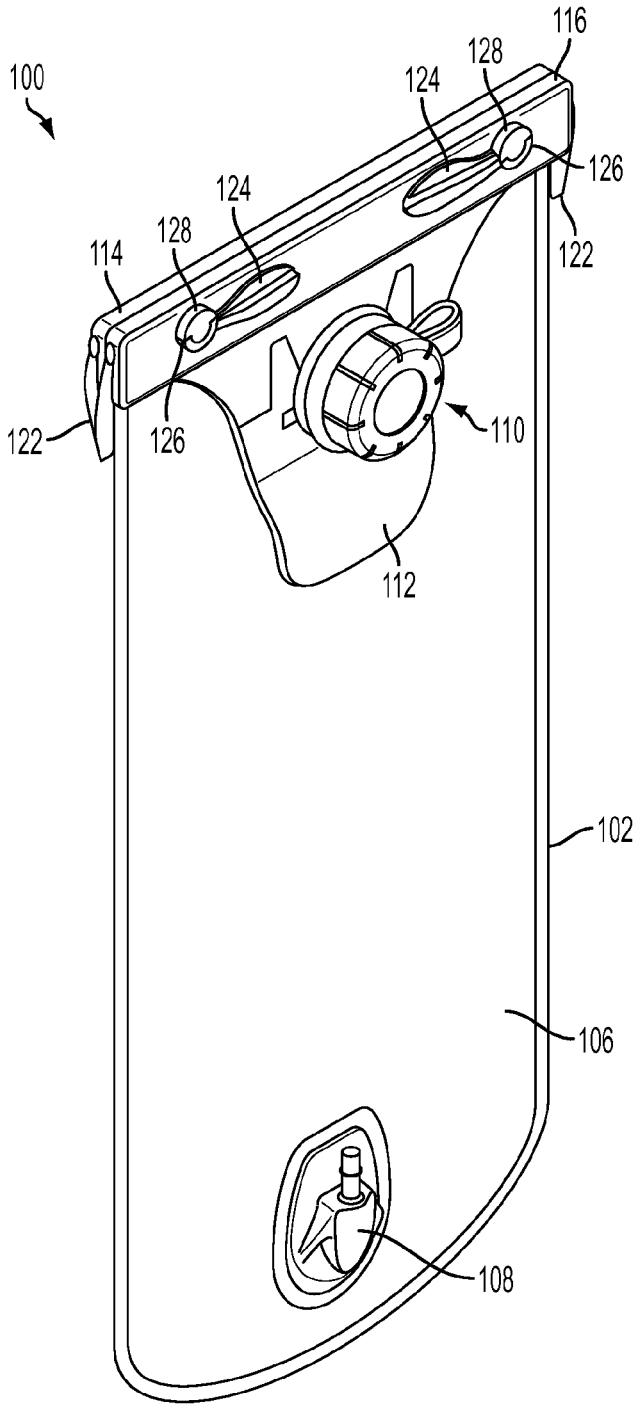
FIG. 10 is a perspective front view of another exemplary fluid bladder having an upper closure.
Figure 11:
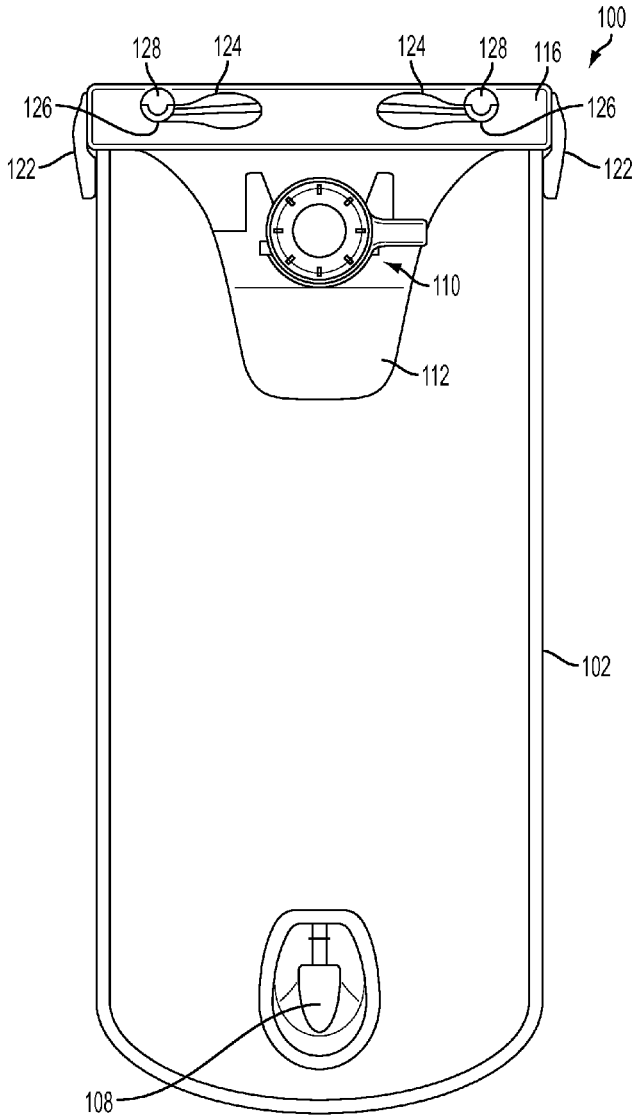
FIG. 11 is a front elevation view of the fluid bladder of FIG. 10.
Figure 12:
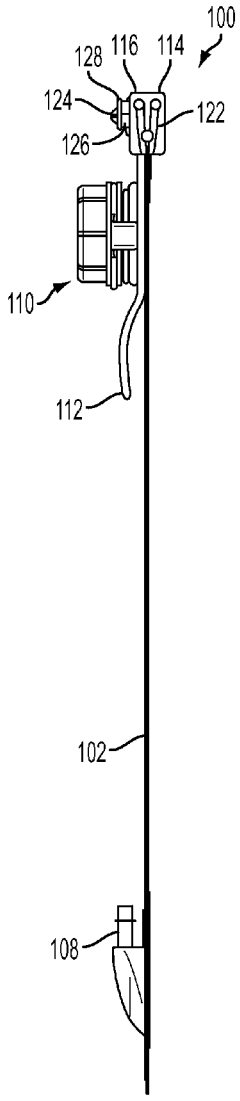
FIG. 12 is a side elevation view of the fluid bladder of FIG. 10.
Figure 13:
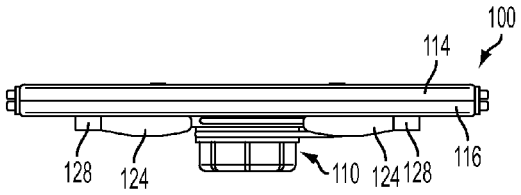
FIG. 13 is a top view of the fluid bladder of FIG. 10.

FIG. 9 shows an alternative embodiment of the bladder assembly 10 of FIG. 8. In this embodiment, handle 76 extends along the vertical length of the bladder and bifurcates struts 90 which are removeably attached to bladder 12 at corners 88. Handle 76 and struts 90 help stretch bladder 12 to maintain a flat shape as the bladder fills with fluid.

FIGS. 10-22 show various views of another bladder assembly 100. The bladder assembly comprises a bladder 102 having a rear sheet 104 and a front sheet 106 that are sealed together around their lower and lateral edges, leaving an upper opening. The assembly 100 can include a lower outlet port 108 and an inlet port 110 that is sealable with a cap. A handle 112 can be coupled to the front sheet 106 of the bladder adjacent to the inlet port 110, such as for holding the bladder horizontally to fill through the inlet port 110, such as under a faucet.

The upper opening of the bladder 102 is attached to a closure assembly for sealing and unsealing the upper opening. The closure assembly comprises a rear rigid member 114 coupled to the upper edge of the rear sheet 104 and a front rigid member 116 coupled to the upper edge of the front sheet 106. The rigid members 114, 116 extend across the width of the upper opening. In some embodiments, the upper edge of the rear sheet 104 can be coupled to the rear member 114 with an intermediate rear liner 118 and the upper edge of the front sheet 106 can be coupled to the front member 116 with an intermediate front liner 120 (see FIGS. 15, 16, and 21). In this way, the sheets 104, 106 need not be welded or otherwise attached directly to the rigid members 114, 116. The liners 118, 120 can be attached to the rigid members 114, 116, respectively, using screws, welds, and other secure means.

Figure 15:
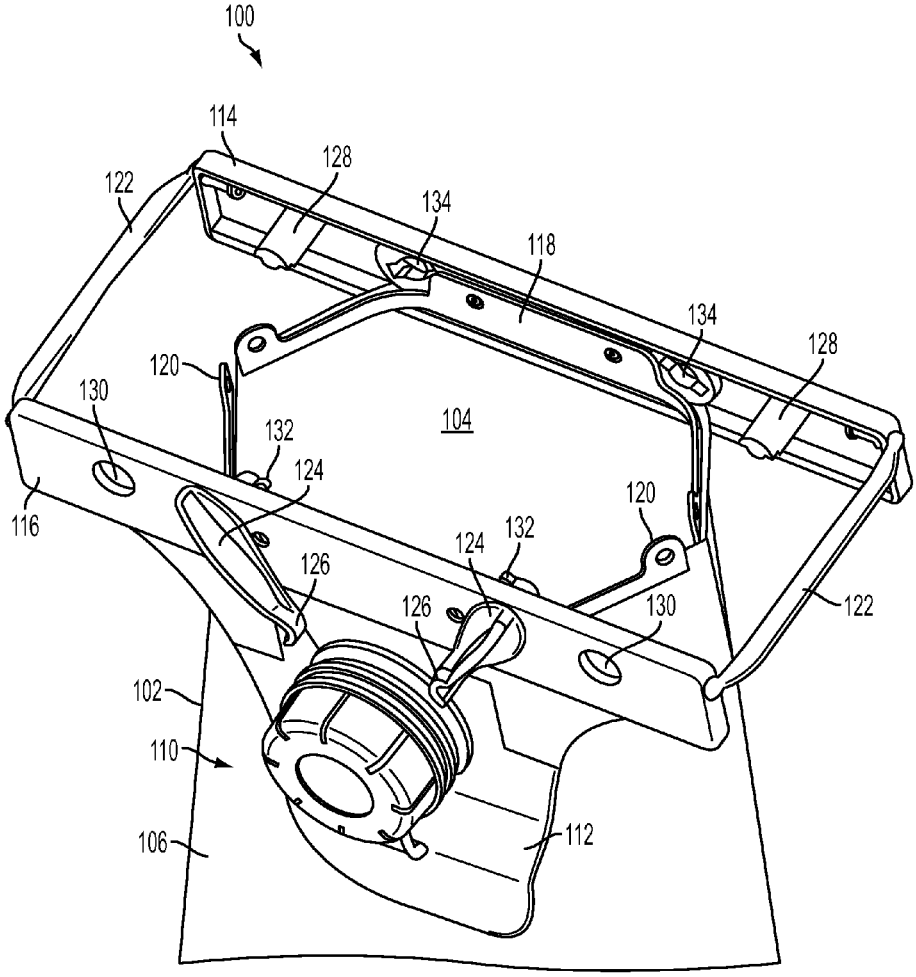
FIGS. 15 and 16 are perspective views of the closure of FIG. 10 in an open position.
Figure 16:
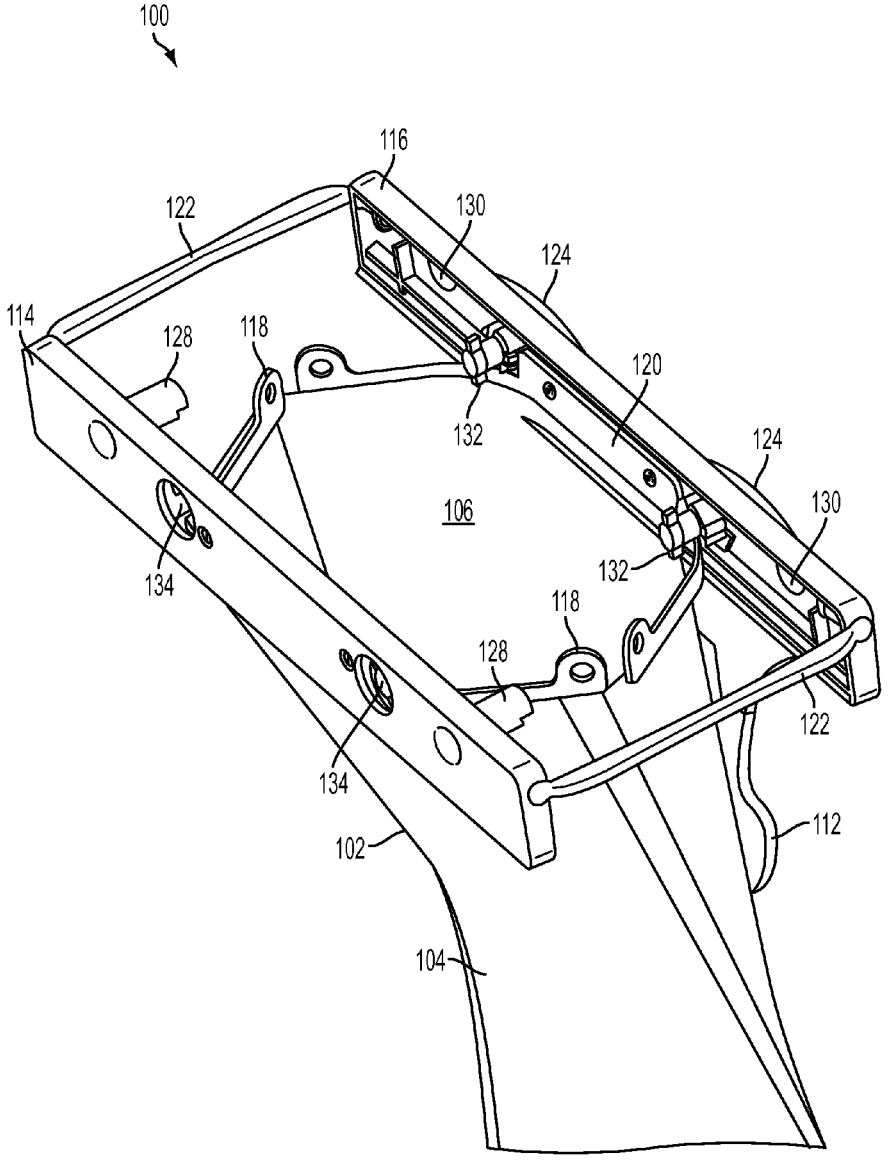

The rigid members 114, 116 can be coupled together at their lateral ends with flexible and/or hinged links, or linkages, 122 that can hold the members 114, 116 in lateral alignment, can guide them into proper sealing alignment, and can provide a limit to the separation distance between the rigid members when the upper opening is open (as shown in FIGS. 15 and 16). In other embodiments, the links 122 can be located inward from the lateral ends of the rigid members 114, 116, or can be located on the liners 118, 120, or can have other forms, such as springs, cords, etc.

Figure 14:
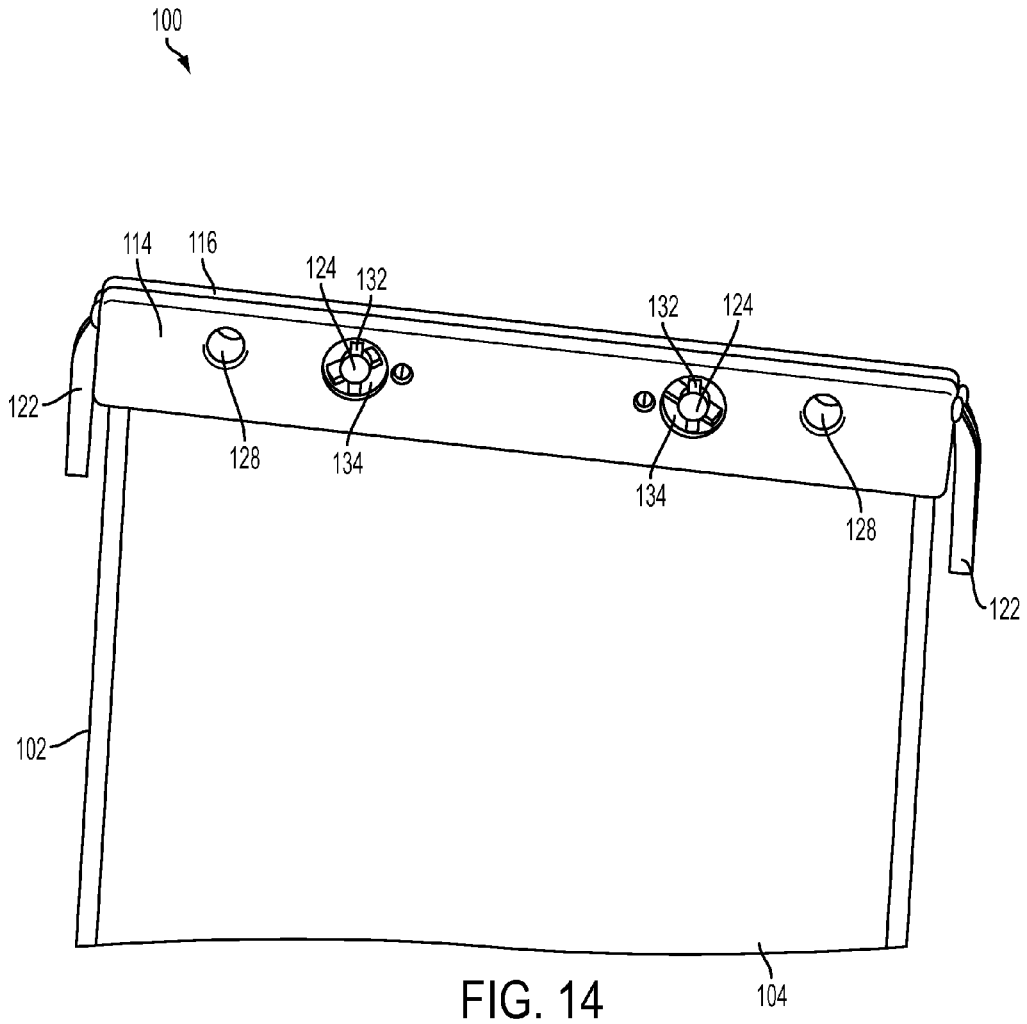
FIG. 14 is a perspective rear view of the closure of FIG. 10 in a closed position.
Figure 21:
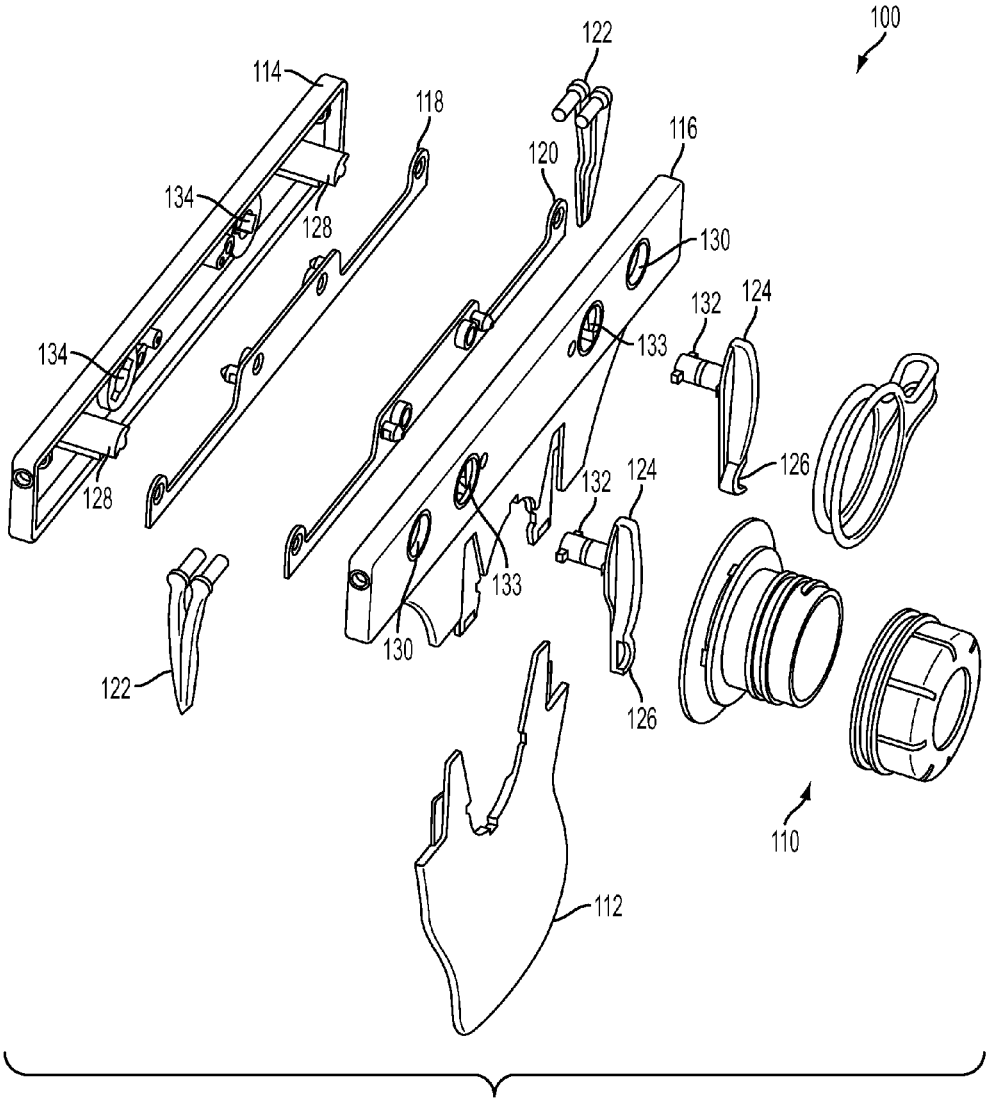
FIGS. 21 and 22 are exploded perspective views of the closure of FIG. 10.
Figure 22:
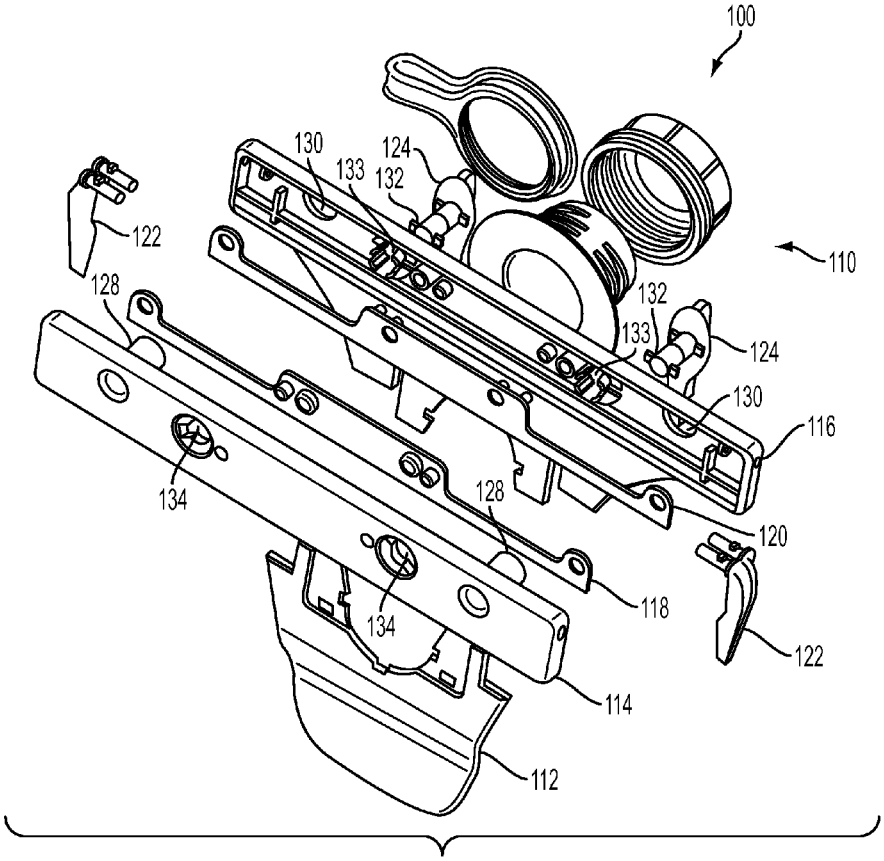

The closure can further comprise one or more fasteners, such as the two fasteners 124, that operate to selectively lock the closure closed to seal off the upper opening of the bladder 102. As shown in FIG. 21, the fasteners 124 extend through openings 133 in the front member 116 and into or through openings 134 in the rear member 114. The fasteners 124 can include tabs, flanges, or cams, 132 on their rear end portions that engage with ramp-like surfaces on rear surfaces of the openings 134 (see FIG. 14), such that rotating the fasteners 124, such as about 90°, can cause the tabs 132 to slide along the ramp-like surfaces of the openings 134 to a closed and/or locked position and create compression between the rigid members 114, 116 that seals the upper opening. FIG. 14 shows such a closed configuration from the rear.

In the closed configuration, the liners 118, 120 and/or the upper ends of the bladder sheets 104, 106 can provide a water-tight seal between the rigid members 114, 116, which are held compressed together by the fasteners 124. In some embodiments, the inner surfaces of the rigid members 114, 116 can form a tongue-and-groove type engagement, such as over the liners 118, 120, in the closed position that further pinches the rear and front sheets 104, 106 together to improve the seal.

Figure 17A:
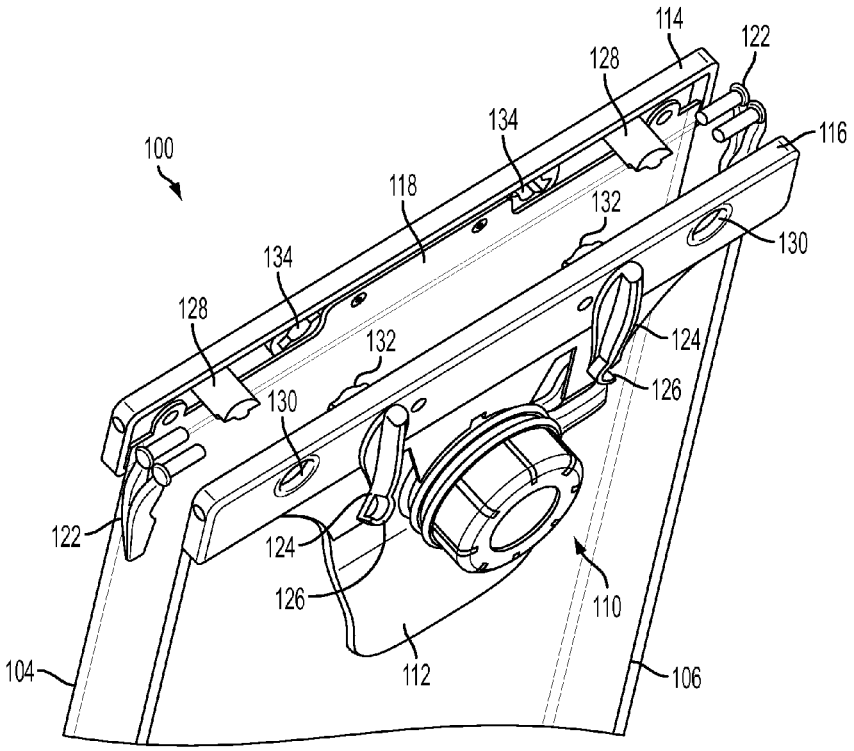
FIG. 17A is a partially exploded perspective view of the closure of FIG. 10 showing the closure components in a partially open position.
Figure 17B:
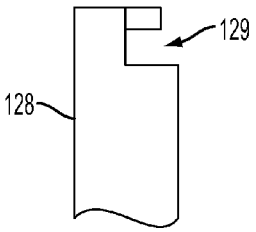
FIG. 17B is a side view of an exemplary projection extending from a rear rigid member of the closure.
Figure 17C:
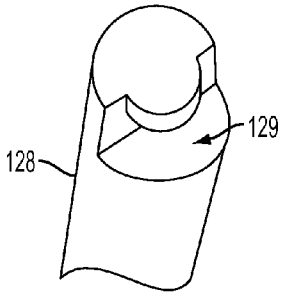
FIG. 17C is a perspective view of the projection of FIG. 17B.
Figure 17D:
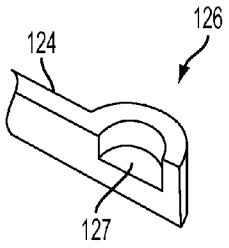
FIG. 17D is a perspective view of an exemplary latch of the closure that mates with the projection of FIG. 17C.
Figure 18:
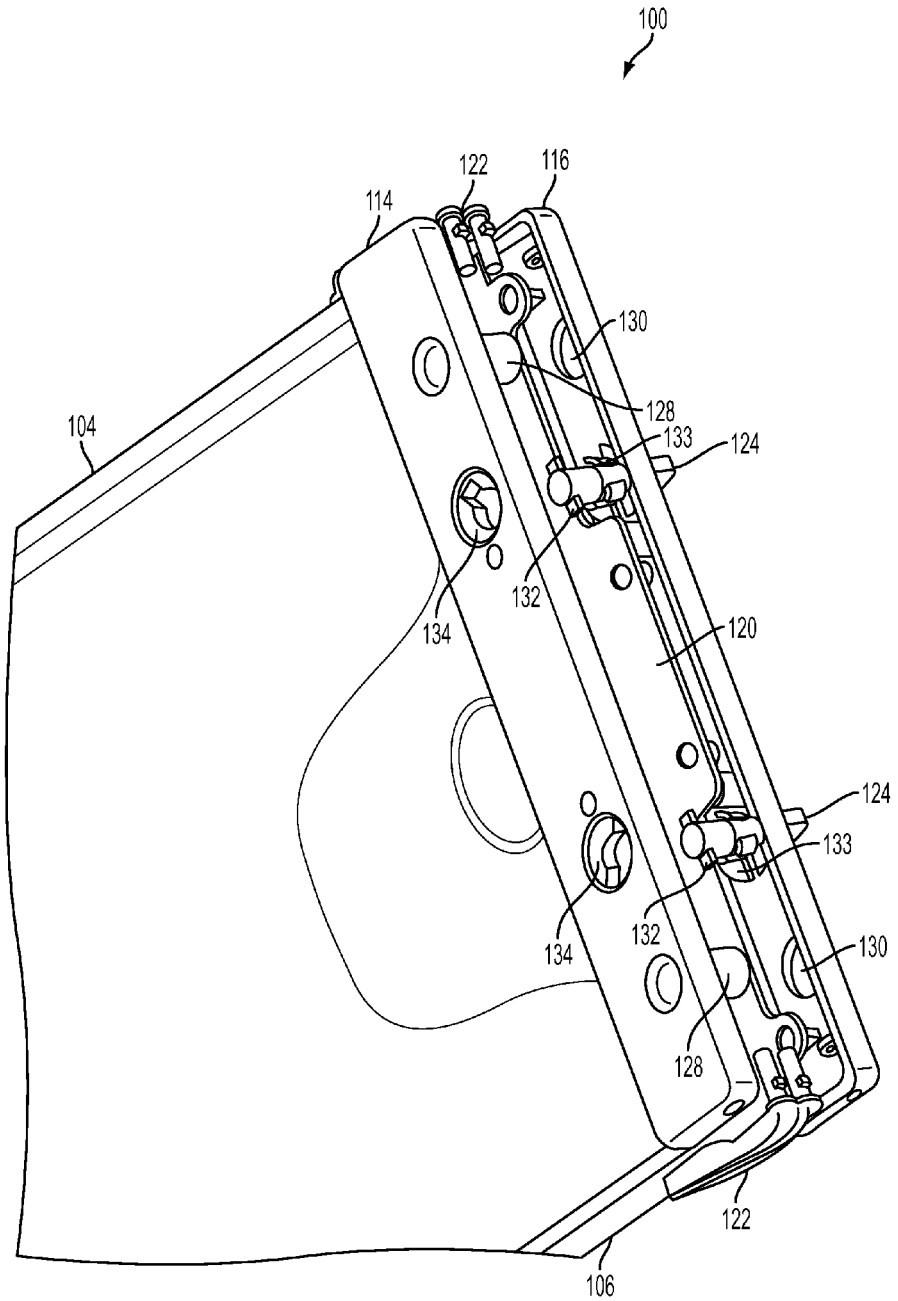
FIG. 18 is another partially exploded perspective view of the closure of FIG. 10 showing the closure components in a partially open position.
Figure 19:
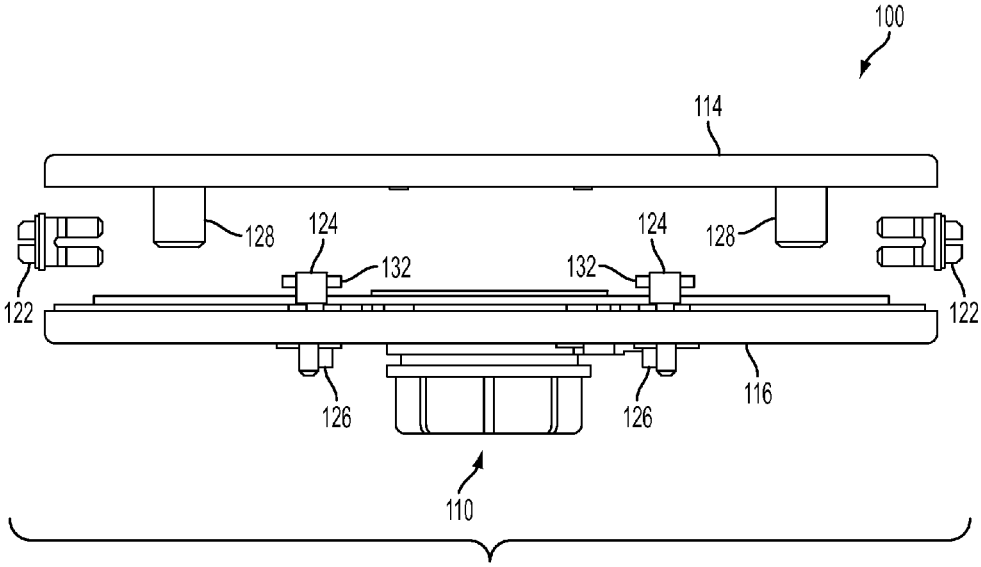
FIGS. 19 and 20 are partially exploded top views of the closure of FIG. 10 showing the closure components in the partially open position.
Figure 20:
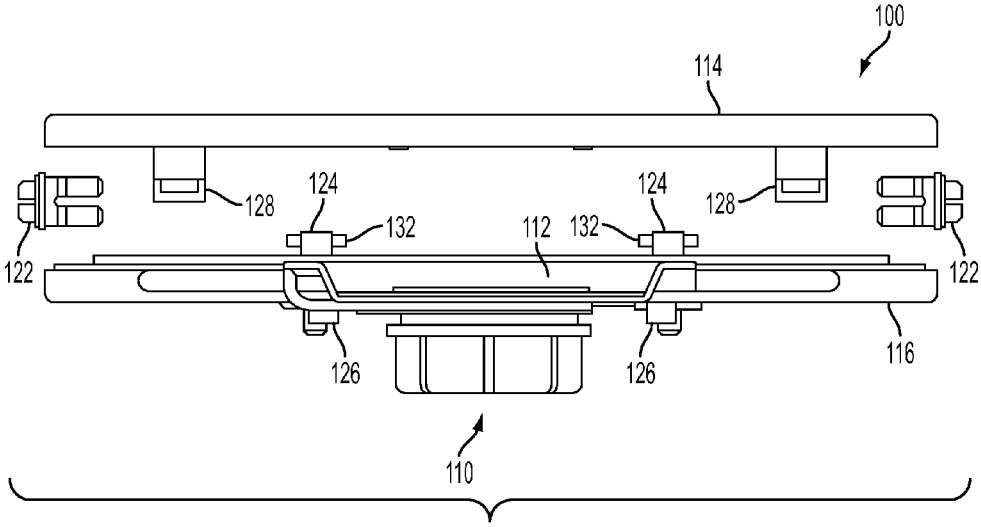

The fasteners 124 can further include latches 126 on the front side or outer side of the front member 116 that extend radially from the rotation axes of the fasteners. An exemplary latch 126 is shown in detail in FIG. 17C. As the fasteners 124 are rotated toward the closed position, each latch 126 can engage with protrusions or projections 128 that extend forward from the rear member 114 and through holes 130 in the front member offset laterally from the openings 133. An exemplary end of a protrusion 128 is shown in FIGS. 17B and 17C. When a fastener 124 is rotated to the closed position (see FIG. 10), an engagement surface 127 of the latch 126 engages with a recess 129 in the projection 128 to lock the fastener in the closed position and maintain the seal. In some embodiments, the locking engagement between the latch 126 and the protrusion 128 can include a snap-fit or friction-fit type engagement such that the engagement surface 127 is secured in the recess 129 and cannot exit the recess without overcoming substantial resistance, thereby preventing the latch from accidentally pivoting away from the protrusion. In some embodiments, the surface 127 and the recess 129 can include corresponding ridges, bumps, or grooves that align in the locked position to enable a snap-fit engagement that resists separation. When the surface 127 is positioned in the recess 129, the protrusion 128 is prevented from pulling out through the hole 130 and thus creates, along with the engagement between the tabs 132 and openings 134, a double-locking configuration for each fastener that secures the closure 100 in the closed position.

This double-locking configuration also provides additional points of compression along the interface between the rear and front rigid member 114, 116, complementing the compression caused by the tabs 132 and the ramp-like surfaces of the openings 134, to more evenly distribute the compression forces along the width of the upper opening of the bladder 102. Furthermore, a single rotation of the fasteners 124 by a user can be sufficient to engage both the tab-and-ramp mechanism and the latch-and-protrusion mechanism at the same time.

Figure 23:
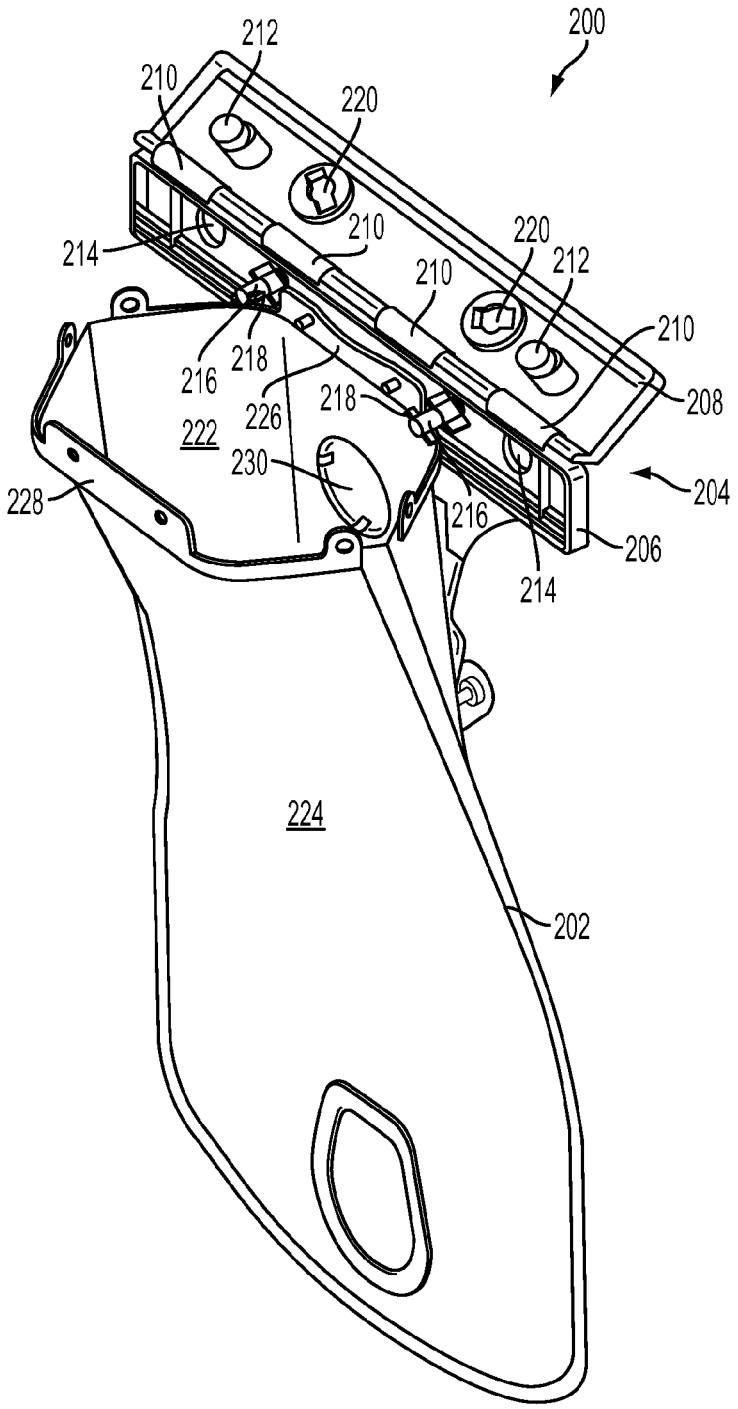
FIG. 23 shows another exemplary fluid bladder having a pivoting upper closure.

FIG. 23 shows yet another exemplary bladder assembly 200. The assembly 200 includes a bladder 202 and an upper closure 204. The upper closure 204 comprises a first rigid member 206 that is secured to rear side 222 of the bladder 202, and a second rigid member 208 that is hingedly coupled to the first rigid member 206 at hinge 210.

An open position is shown in FIG. 23. To close the bladder (not shown), the second member 208 is pivoted about the hinge(s) 210 and against the front side 224 of the upper end of the bladder 202, pinching the upper opening of the bladder between the first and second members 206, 208. Fasteners as described above with reference to assembly 100 can then be used in a similar manner to lock the closure in a closed, water-tight configuration. For example, projections 212 can extend through openings 214 while shafts 216 with cams 218 can extend through ramped openings 220. An outer latch (not shown) extending from each shaft 216 can be pivoted to cause the cams 218 to engage with the ramped openings 220 in the second rigid member 208 and/or to engage the outer latches with the projections 212 behind the first rigid member 206, as described above with embodiment 100. Liners 228 and 226 can also be provided at the top edge of the bladder to provide a more fluid tight seal between the rigid members 206, 208. A lateral fill port 230 can also be included, such as built into a handle portion extending from the first rigid member 206.

Figure 24B:
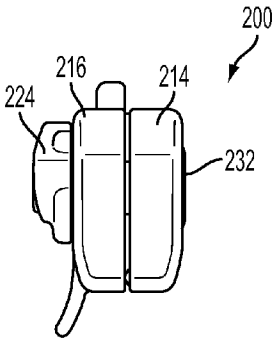
FIG. 24B is a side view of the closure of FIG. 24A in the closed position.
Figure 24A:
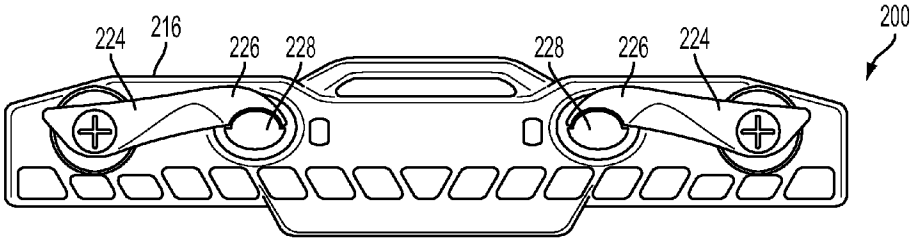
FIG. 24A is a front view of another exemplary closure, shown in a closed position.
Figure 24C:
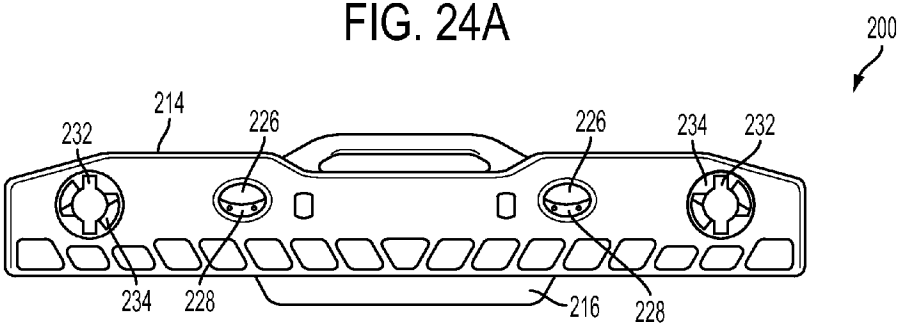
FIG. 24C is a rear view of the closure of FIG. 24A in the closed position.
Figure 24D:
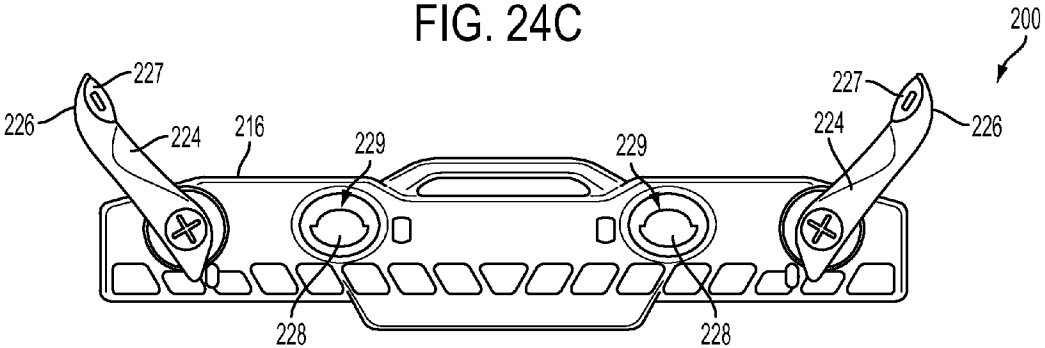
FIG. 24D is a front view of the closure of FIG. 24A in an unlocked or open position.

FIGS. 24A-24D shows an alternative embodiment of a closure 200 that is similar to the closure 100 described above. FIG. 24A shows a front view of the closure 200 in the closed position, FIG. 24B shows a side view of the closure 200 in the closed position, and FIG. 24C shows a rear view of the closure 200 in the closed position. FIG. 24D shows a front view of the closure 200 in an unlatched and/or open position. The closure includes a rear plate 214, a front plate 216, and two wide set fasteners 224 that are pivotably mounted in the front plate. The rear plate 214 includes projections 228 that are positioned between the pivot axes of the fasteners 224 and that extend through openings in the front plate 214 to engage with the latches 226 of the fasteners to provide a clamping and locking mechanism. The fasteners 224 also project through the front plate 216 at their pivot axes and include tabs 232 that engage with ramped engagement openings 234 in the rear plate (FIG. 24C) to provide a clamping force between the plates. As shown in FIG. 24D, the ends of the projections can include recesses or notches 229 that receive engagement surfaces 227 of the latches 226. The recesses or notches 229 and engagement surfaces 227 can be shaped similar to as shown and described with reference to FIGS. 17B, 17C, and 17D. The closure 200 can be structured and can function similarly to the closure 100, but with the latches and the projections reversed.

The various closures described herein may be integrated with a hydration pack's bladder compartment opening so that the bladder interior can be accessed via a single opening step.

The embodiments disclosed may be utilized with various sizes and types of bladders including soft-sided and semi-flexible versions as well as bladders made from a variety of materials, including, PVC, polyurethane, polyethylene, silicone, and/or others.

The singular terms "a", "an", and "the" include plural referents unless context clearly indicates otherwise. The term "comprises" means "includes without limitation." The term "coupled" means physically linked and does not exclude intermediate elements between the coupled elements. The term "and/or" means any one or more of the elements listed. Thus, the term "A and/or B" means "A", "B" or "A and B."

Although methods and materials similar or equivalent to those described herein can be used in the practice or testing of the present technology, only certain suitable methods and materials are described herein. In case of conflict, the present specification, including terms, will control. In addition, the materials, methods, and devices are illustrative only and not intended to be limiting.

In view of the many possible embodiments to which the principles of the disclosed technology may be applied, it should be recognized that the illustrated embodiments are only examples and should not be taken as limiting the scope of the disclosure. Rather, the scope of the disclosure is at least as broad as the following claims. I therefore claim all that comes within the scope of the following claims.

The invention claimed is:

1. A bladder closure comprising:

a first rigid member adapted to be secured to a first side of a bladder opening, the first rigid member comprising at least one fastener mounting opening and at least one hole spaced from the fastener mounting opening;

a second rigid member adapted to be secured to a second side of the bladder opening opposite from the first side, the second rigid member comprising at least one fastener engagement opening and at least one projection spaced from the fastener engagement opening;

at least one fastener for securing the first and second rigid members together to seal the bladder opening, the fastener being rotatably mounted in the fastener mounting opening of the first rigid member, the fastener comprising a latch positioned on an outer side of the first rigid member and a shaft that passes through the fastener mounting opening and extends from an inner side of the first rigid member, wherein the shaft includes at least one tab that projects from a portion of the shaft on the inner side of the first rigid member, and wherein the latch extends radially from a portion of the shaft on the outer side of the first rigid member and the latch includes a locking portion that pivots with the shaft at least partially around an axis of the shaft;

wherein when the bladder closure is in an open position, the first rigid member is spaced apart from the second rigid member; and wherein when the bladder closure is in a closed position, the tab that projects from the fastener shaft is engaged with the fastener engagement opening in the second rigid member to provide a clamping force that clamps the first and second rigid members together to seal a bladder opening, and the projection of the second rigid member extends through the hole in the first rigid member and the locking portion of the latch is engaged with the projection on the outer side of the first rigid member to lock the fastener in the closed position;

wherein the locking portion of the latch includes a first locking surface and the projection includes a second locking surface, and in the closed position the first and second locking surfaces are pressed against each other, such that the engagement between the locking portion of the latch and the projection creates a second clamping force that urges the first and second rigid members together.

2. The bladder closure of claim 1, wherein the latch rotates about the shaft from an unlocked position, wherein the tab is not engaged with the fastener engagement opening and the locking portion of the latch is not engaged with the projection, to the closed position.

3. The bladder closure of claim 1, wherein the fastener engagement opening includes a ramped surface that engages with the tab as the shaft rotates to generate the clamping force.

4. The bladder closure of claim 1, wherein the projection includes a locking recess configured to lockingly engage with the locking portion of the latch, such that rotation of the latch is restricted until the locking engagement is forcibly overcome.

5. The bladder closure of claim 1, further comprising a second fastener spaced from the first fastener and configured to clamp the first and second rigid members together in the closed position upon rotating the second fastener to a locked position, the second fastener being rotatably mounted in a second fastener mounting opening in the first rigid member, the second fastener comprising a second shaft that passes through the second fastener mounting opening and extends from the inner side of the first rigid member, wherein the second shaft includes at least one tab that projects from a portion of the second shaft on the inner side of the first rigid member, and wherein when the bladder closure is in a closed position, the tab that projects from the second shaft is engaged with a second fastener engagement opening in the second rigid member to provide a second clamping force that clamps the first and second rigid members together.

6. The bladder closure of claim 5, further comprising a second projection on the second rigid member, wherein the two fasteners are positioned between the two projections.

7. The bladder closure of claim 6, wherein the second fastener comprises a second latch positioned on the outer side of the first rigid member, the second latch extends radially from a portion of the second shaft on the outer side of the first rigid member, the second latch includes a locking portion that pivots with the second shaft at least partially around an axis of the second shaft, and when the bladder is in the closed position the second projection extends through a second hole in the first rigid member and the locking portion of the second latch engages with the second projection on the outer side of the first rigid member to lock the second fastener in a closed position.

8. The bladder closure of claim 1, further comprising a first linkage attached to a first lateral end of the first rigid member and a first lateral end of the second rigid member, wherein the first linkage maintains the first and second linkages in alignment with each other and flexes to allow the first and second rigid members to move between the open and closed positions in alignment with each other.

9. The bladder closure of claim 8, wherein the first linkage limits a maximum separation distance between the first and second rigid members.

10. The bladder closure of claim 1, further comprising a rigid handle portion extending from the first rigid member or from the second rigid member.

11. The bladder closure of claim 10, wherein the rigid handle portion supports a fluid port that provides lateral access into a bladder, the fluid port being different from the bladder opening sealed by the bladder closure.

12. The bladder closure of claim 1, further comprising a first bladder liner positioned between the first rigid member and the first side of the bladder opening, and a second bladder liner positioned between the second rigid member and the second side of the bladder opening.

13. A bladder assembly comprising:

a bladder including a first sheet sealed to a second sheet to form an upper opening between the first and second sheets; and a bladder closure secured to the upper opening of the bladder for opening and closing the upper opening, wherein the bladder closure comprises a first rigid member, a second rigid member, and at least one fastener for securing the first and second rigid members together to seal the upper opening of the bladder;

wherein the at least one fastener is rotatably mounted in the first rigid member and includes a latch positioned on an outer side of the first rigid member and a shaft that passes through the first rigid member, wherein the shaft includes at least one tab that projects from the shaft to engage with the second rigid member in a closed position to provide a clamping force that clamps the first and second rigid members together to seal the upper opening of the bladder, and wherein the latch pivots at least partially around an axis of the shaft on the outer side of the first rigid member to engage with a projection extending from the second rigid member through a hole in the first rigid member offset laterally from the shaft to lock the bladder closure in the closed position;

further comprising a fluid inlet port in either the first sheet or the second sheet adjacent to the upper opening that provides access into the bladder, the fluid inlet port being different from the bladder opening sealable by the bladder closure, such that the bladder can be filled with fluid through either the upper opening or the fluid inlet port.

14. The bladder assembly of claim 13, further comprising a rigid handle extending from the bladder closure and the fluid inlet port that allows a user to hold the bladder assembly in a horizontal position with the fluid inlet port facing up to allow falling fluid to enter the fluid inlet port.

15. The bladder assembly of claim 13, wherein the first rigid member is secured to the first sheet adjacent the bladder opening, wherein the second rigid member is hingedly coupled to the first rigid member such that the second rigid member can pivot relative to the first rigid member to a position adjacent the second sheet on a second side of the bladder opening;

wherein when the bladder closure is in an open position, the second rigid member is pivoted relative to the first rigid member away from the second side of the bladder opening and the second side of the bladder opening is free to move apart from the first side of the bladder opening; and wherein when the bladder closure is in a closed position, the second rigid member is pivoted into engagement with the second side of the bladder opening and the tab that projects from the fastener shaft is engaged with a fastener engagement opening in the second rigid member to provide a clamping force that clamps the first and second rigid members together to seal the first and second sides of the bladder opening together, and the projection of the second rigid member extends through the hole in the first rigid member and a locking portion of the latch is engaged with the projection on the outer side of the first rigid member to lock the fastener in the closed position.

16. The bladder assembly of claim 13, wherein a fastener engagement opening in the second rigid member includes a ramped surface that engages with the tab as the shaft rotates to generate a clamping force.

17. The bladder assembly of claim 13, wherein the projection includes a locking recess configured to lockingly engage with a locking portion of the latch, such that rotation of the latch away from the projection is restricted until the locking engagement is forcibly overcome.

18. The bladder assembly of claim 13, further comprising a second fastener rotatably mounted in the first rigid member and spaced laterally from the first fastener and the projection, the second fastener configured to clamp the first and second rigid members together in the closed position upon rotating the second fastener to a locked position, and further comprising a second projection on the second rigid member that locks with a latch of the second fastener upon rotation of the second fastener.

19. The bladder assembly of claim 18, wherein the two fasteners and the two projections form four clamping force generation locations across the bladder closure to more evenly seal the upper opening.

* * * * *